United States Patent [19]

Vickers

[11] 4,423,006

[45] Dec. 27, 1983

[54] FLUID CATALYST REGENERATION APPARATUS

[75] Inventor: Anthony G. Vickers, Arlington Heights, Ill.

[73] Assignee: UOP Inc., Des Plaines, Ill.

[21] Appl. No.: 423,373

[22] Filed: Sep. 24, 1982

Related U.S. Application Data

[62] Division of Ser. No. 265,502, May 20, 1981, Pat. No. 4,371,453.

[51] Int. Cl.[3] ..... F27B 15/08; B01J 21/20; B01J 29/38; C10G 11/18

[52] U.S. Cl. ..... 422/109; 208/164; 422/105; 422/106; 422/111; 422/144; 422/146; 502/38

[58] Field of Search ..... 422/105, 106, 144, 146, 422/109, 111; 252/417; 208/164

[56] References Cited

U.S. PATENT DOCUMENTS

| | | | |
|---|---|---|---|
| 2,439,811 | 4/1948 | Jewell | 252/417 X |
| 2,492,948 | 1/1950 | Berger | 252/417 |
| 2,515,156 | 7/1950 | Jahnig et al. . | |
| 2,596,748 | 5/1953 | Watson et al. | 252/417 |
| 2,684,931 | 7/1954 | Berg | 422/144 X |
| 2,756,216 | 7/1956 | Yoder | 252/417 |
| 2,777,804 | 1/1957 | Nicolai | 252/417 |
| 2,862,798 | 12/1958 | McKinney . | |
| 2,873,175 | 2/1959 | Owens . | |
| 2,883,335 | 4/1959 | Smith | 422/144 X |
| 2,970,117 | 1/1961 | Harper | 252/417 |
| 3,351,548 | 11/1967 | Payne et al. | 252/417 |
| 3,378,483 | 4/1968 | Warrell et al. | 422/144 X |
| 3,893,812 | 7/1975 | Conner et al. . | |
| 3,898,050 | 8/1975 | Strother . | |
| 3,953,175 | 4/1976 | Pulak . | |
| 3,990,992 | 11/1976 | McKinney | 252/417 |
| 4,032,299 | 6/1977 | Pulak . | |
| 4,033,728 | 7/1977 | Aoki et al. | 44/1 R |
| 4,035,284 | 7/1977 | Gross et al. | 208/120 |
| 4,065,269 | 12/1977 | Pulak . | |
| 4,219,442 | 8/1980 | Vickers | 252/417 |
| 4,220,622 | 9/1980 | Kelley | 422/109 |

*Primary Examiner*—Barry S. Richman

*Attorney, Agent, or Firm*—James R. Hoatson, Jr.; Louis A. Morris; William H. Page, II

[57] ABSTRACT

An apparatus for regenerating coke-contaminated fluid catalyst which comprises a vertical combustion chamber, an inlet to said chamber for spent catalyst and regeneration gas, a disengagement chamber above and in communication with the combustion chamber, a heat removal chamber below the combustion chamber in which may be maintained a dense phase catalyst bed, heat removal means positioned within the heat removal chamber such that it will be immersed in the catalyst bed, a recycle conduit for passing catalyst from the disengagement chamber to the heat removal chamber, a vertical cooled catalyst inlet conduit connecting the heat removal chamber with the lower portion of the combustion chamber so that catalyst can pass from the former to the latter, and a regeneration gas inlet line connecting with a lower part of the cooled catalyst inlet conduit to enable the flow of cooled catalyst up into the combustion chamber, wherein a control system senses the catalyst level in the heat removal zone, formulates an output signal via a level control means having an adjustable set point, and regulates the flow rate of regeneration gas into the cooled catalyst inlet conduit via transmission of the output signal to a flow control means responsive thereto and thereby controls such level.

3 Claims, 1 Drawing Figure

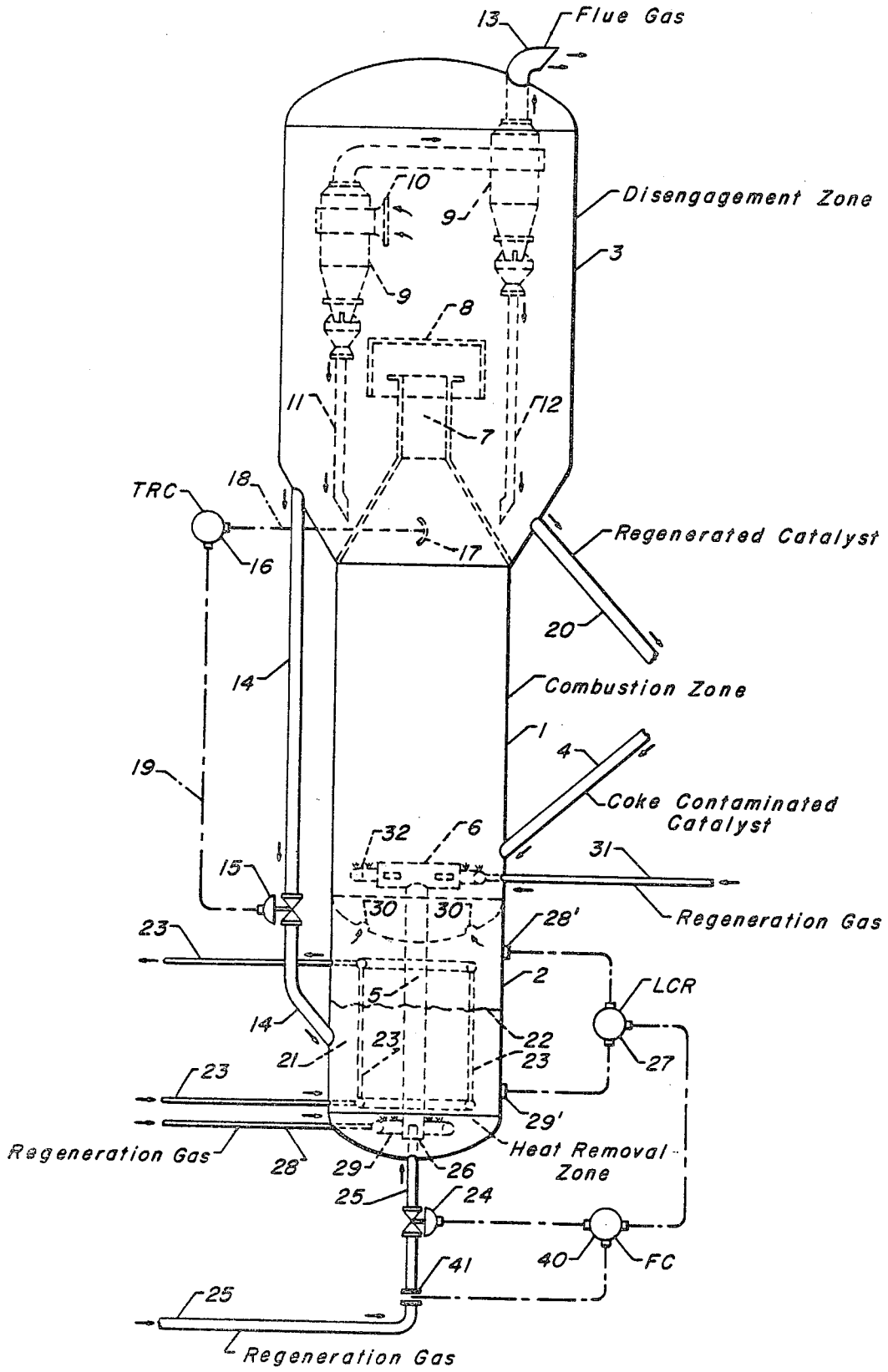
13
Flue Gas
10
9
Disengagement Zone
3
9
8
11
12
7
TRC
18
17
Regenerated Catalyst
16
20
14
Combustion Zone
1
4
19
Coke Contaminated Catalyst
32
6
31
15
30
30
Regeneration Gas
23
28'
2
LCR
5
14
22
23
21
23
27
23
29'
Regeneration Gas
28
29
26
Heat Removal Zone
25
24
40
FC
41
25
Regeneration Gas

FLUID CATALYST REGENERATION APPARATUS

CROSS REFERENCE TO RELATED APPLICATIONS

This is a division of prior copending application Ser. No. 265,502 filed May 20, 1981, and issued on Feb. 1, 1983 as U.S. Pat. No. 4,371,453 incorporated herein by reference.

BACKGROUND OF THE INVENTION

The field of art to which this invention pertains is fluid catalyst regeneration. It relates to the rejuvenation of particulated solid, fluidizable catalyst which has been contaminated by the deposition thereupon of coke. The present invention will be most useful in a process for regenerating coke-contaminated fluid cracking catalyst, but it should find use in any process in which coke is burned from a solid, particulated, fluidizable catalyst.

DESCRIPTION OF THE PRIOR ART

The fluid catalytic cracking process (hereinafter FCC) has been extensively relied upon for the conversion of starting materials, such as vacuum gas oils, and other relatively heavy oils, into lighter and more valuable products. FCC involves the contact in a reaction zone of the starting material, whether it be vacuum gas oil or another oil, with a finely divided, or particulated, solid, catalytic material which behaves as a fluid when mixed with a gas or vapor. This material possesses the ability to catalyze the cracking reaction, and in so acting it is surface-deposited with coke, a by-product of the cracking reaction. Coke is comprised of hydrogen, carbon and other material such as sulfur, and it interferes with the catalytic activity of FCC catalysts. Facilities for the removal of coke from FCC catalyst, so-called regeneration facilities or regenerators, are orginarily provided within an FCC unit. Regenerators contact the coke-contaminated catalyst with an oxygen-containing gas at conditions such that the coke is oxidized and a considerable amount of heat is released. A portion of this heat escapes the regenerator with flue gas, comprised of excess regeneration gas and the gaseous products of coke oxidation, and the balance of the heat leaves the regenerator with the regenerated, or relatively coke-free, catalyst. Regenerators operating at superatmospheric pressures are often fitted with energy-recovery turbines which expand the flue gas as it escapes from the regenerator and recover a portion of the energy liberated in the expansion.

The fluidized catalyst is continuously circulated from the reaction zone to the regeneration zone and then again to the reaction zone. The fluid catalyst, as well as providing catalytic action, acts as a vehicle for the transfer of heat from zone to zone. Catalyst exiting the reaction zone is spoken of as being "spent", that is partially deactivated by the deposition of coke upon the catalyst. Catalyst from which coke has been substantially removed is spoken of as "regenerated catalyst".

The rate of conversion of the feedstock within the reaction zone is controlled by regulation of the temperature, activity of catalyst and quantity of catalyst (i.e. catalyst to oil ratio) therein. The most common method of regulating the temperature is by regulating the rate of circulation of catalyst from the regeneration zone to the reaction zone which simultaneously increases the catalyst/oil ratio. That is to say, if it is desired to increase the conversion rate an increase in the rate of flow of circulating fluid catalyst from the regenerator to the reactor is effected. Inasmuch as the temperature within the regeneration zone under normal operations is invariably higher than the temperature within the reaction zone, this increase in influx of catalyst from the hotter regeneration zone to the cooler reaction zone effects an increase in reaction zone temperature. It is interesting to note that: this higher catalyst circulation rate is sustainable by virtue of the system being a closed circuit; and, the higher reactor temperature is sustainable by virtue of the fact that increased reactor temperatures, once effected, produce an increase in the amount of coke being formed in the reaction and deposited upon the catalyst. This increased production of coke, which coke is deposited upon the fluid catalyst within the reaction, provides, upon its oxidation within the regenerator, an increased evolution of heat. It is this increased heat evolved within the regeneration zone which, when conducted with the catalyst to the reaction zone, sustains the higher reactor temperature operation.

Recent politico-economic restraints which have been put upon the traditional lines of supply of crude oil have made necessary the use, as starting materials in FCC units, of heavier-than-normal oils. FCC units must now cope with feedstocks such as residual oils and in the future may require the use of mixtures of heavy oils with coal or shale derived feeds.

The chemical nature and molecular structure of the feed to the FCC unit will affect that level of coke on spent catalyst. Generally speaking, the higher the molecular weight, the higher the Conradson carbon, the higher the heptane insolubles, and the higher the carbon to hydrogen ratio, the higher will be the coke level on the spent catalyst. Aslo high levels of combined nitrogen, such as is found in shale derived oils, will also increase the coke level on spent catalyst. The processing of heavier and heavier feedstocks, and particularly the processing of deasphalted oils, or direct processing of atmospheric bottoms from a crude unit, commonly referred to as reduced crude, does cause an increase in all or some of these factors and does therefore cause an increase in coke level on spent catalyst.

This increase in coke on spent catalyst results in a larger amount of coke burnt in the regenerator per pound of catalyst circulated. Heat is removed from the regenerator in conventional FCC units in the flue gas and principally in the hot regenerated catalyst stream. An increase in the level of coke on spent catalyst will increase the temperature difference between the reactor and the regenerator, and in the regenerated catalyst temperature. A reduction in the amount of catalyst circulated is therefore necessary in order to maintain the same reactor temperature. However, this lower catalyst circulation rate required by the higher temperature difference between the reactor and the regenerator will result in a fall in conversion, making it necessary to operate with a higher reactor temperature in order to maintain conversion at the desired level. This will cause a change in yield structure which may or may not be desirable, depending on what products are required from the process. Also there are limitations to the temperatures that can be tolerated by FCC catalyst without there being a substantial detrimental effect on catalyst activity. Generally, with commonly available modern FCC catalyst, temperatures of regenerated catalyst are usually maintained below 1350° F., since loss of activity would be very severe about 1400°–1450° F. If a relatively common reduced crude such as that derived from Light Arabian crude oil were charged to a conventional FCC unit, and operated at a temperature required for high conversion to lighter products, i.e. similar to that for a gas oil charge, the regenerator temperature would operate in the range of 1600°-1800° F. This would be too high a temperature for the catalyst, require very expensive materials of construction, and give an extremely low catalyst circulation rate. It is therefore accepted that when materials are processed that would give excessive regenerator temperatures, a means must be provided for removing heat from the regenerator, which enables a lower regenerator temperature, and a lower temperature difference between the reactor and the regenerator.

A common prior art method of heat removal provides coolant-filled coils within the regenerator, which coils are in contact either with the catalyst from which coke is being removed or with the flue gas just prior to the flue gas' exit from the regenerator. For example, McKinney U.S. Pat. No. 3,990,992 discloses a fluid catalytic cracking process dual zone regenerator with cooling coils mounted in the second zone. The second zone is for catalyst disengagement prior to passing the flue gas from the system, and contains catalyst in a dilute phase. Coolant flowing through the coils absorbs heat and removes it from the regenerator.

These prior art coils within the regenerator have been found to be inflexible in that they are usually sized to remove the quantity of heat which will be liberated by the prospective feedstock which is most extensively coke-forming. Difficulties arise when a feedstock of lesser coke-forming characteristics is processed. In such a case the heat removal coils are now oversized for the job at hand. They, consequently, remove entirely too much heat. When heat removal from the regenerator is higher than that required for a particular operation, the temperature within the regenerator is depressed. This leads to a lower than desired temperature of regenerated catalyst exiting the regenerator. The catalyst circulation rate required to obtain the desired reaction zone temperature will increase, and may exceed the mechanical limitations of the equipment.

The coke production rate will be higher than necessary on this feedstock, and the lower temperature will result in less efficient coke burning in the regeneration zone, with a greater amount of residual coke on regenerated catalyst. Furthermore, the presence of inflexible heat removal coils within the coke-oxidizing section of the regenerator often drastically extends the time period required for raising the regenerator to its operational temperature level.

It is also known to the art to have cooling coils immersed in a relatively dense phase fluid catalyst bed comprising a portion of the regenerated catalyst removed from the combustion zone. The cooled regenerator catalyst is then recycled back to the combustion zone, thereby enabling control of the combustion zone temperature. The dense phase fluid catalyst bed heat removal zone may be located superadjacent to the combustion zone and integral with the regenerator vessel, or, as disclosed in U.S. Pat. Nos. 2,492,948; 2,515,156; 2,596,748; 2,862,798; 2,873,175; and 2,970,117, may be partially or completely external from the regenerator vessel.

Like the basic concept of heat removal from FCC regenerators, the basic concept of internal and external recycle of catalyst particles in FCC regenerators, is not, per se, novel. Examples of such concepts are taught in Gross et al U.S. Pat. No. 4,035,284, Pulak U.S. Pat. No. 3,953,175, Strother, U.S. Pat. No. 3,898,050, Conner et al U.S. Pat. No. 3,893,812, Pulak U.S. Pat. No. 4,032,299, Pulak U.S. Pat. No. 4,033,728, and Pulak U.S. Pat. No. 4,065,269.

The regeneration apparatus and process disclosed herein achieves a unique and highly efficient integration of a relatively dense phase fluid catalyst heat removal zone with an FCC regenerator, including means and a method for controlling the level of the dense phase bed and thus the extent of immersion of the heat removal means in such bed.

SUMMARY OF THE INVENTION

Accordingly, the invention is, in one embodiment, an apparatus for regenerating a coke-contaminated, fluid catalyst, which apparatus comprises in combination: (a) a vertically-oriented combustion chamber having means by which the coke-contaminated fluid catalyst may be introduced therein and contacted with regeneration gas; (b) a fluid catalyst disengagement chamber located superadjacent to and above the combustion chamber and in communication therewith; (c) a heat removal chamber located superadjacent to and below the combustion chamber in which may be maintained a dense phase fluid catalyst bed; (d) heat removal means positioned within the heat removal chamber so as to enable immersion of the heat removal means in the dense phase fluid catalyst bed; (e) a catalyst recycle conduit connecting the disengagement chamber with the heat removal chamber, such that hot regenerated fluid catalyst can pass from the disengagement chamber to the heat removal chamber; (f) a cooled catalyst transfer or inlet conduit of vertical orientation connecting the lower portion of the heat removal chamber with the lower portion of the combustion chamber, such that fluid catalyst can pass from the dense phase fluid catalyst bed in the heat removal chamber to the combustion chamber; (g) a regeneration gas inlet line connecting with a lower portion of the cooled catalyst inlet conduit for introducing at least a portion of regeneration gas into the lower portion of the cooled catalyst inlet conduit below the level of the dense phase fluid catalyst bed, thereby effecting the flow of cooled fluid catalyst from the dense phase fluid catalyst bed in the heat removal chamber to the combustion chamber; and (h) a control system for maintaining the extent of immersion of the heat removal means in the dense phase fluid catalyst bed by maintaining the level of the dense phase fluid catalyst bed in the heat removal zone comprising means to sense the level, level control means having an adjustable set point and developing a level output signal, flow control means regulating the rate of flow of the regeneration gas into the cooled catalyst inlet conduit, and means for transmitting the level output signal to the flow control means whereby the latter is adjusted responsive to the level, thereby maintaining the level and the extent of immersion of the heat removal means in accordance with the desired set point.

In another embodiment my invention is a process for regenerating a coke-contaminated fluid catalyst, the process including the steps of: (a) introducing oxygen-containing regeneration gas, coke-contaminated fluid catalyst into a lower locus of a combustion zone maintained at a temperature sufficient for coke-oxidation and therein oxidizing coke to produce hot regenerated catalyst and hot flue gas; (b) transporting the hot flue gas and a portion of the hot regenerated catalyst into a regenerated catalyst disengaging zone, wherein the hot regenerated catalyst is separated from the flue gas; (c) passing a portion of hot regenerated catalyst from the disengaging and receiving zone to a heat removal zone and therein maintaining the catalyst at dense-phase fluid bed conditions, the combination and heat removal zones being substantially vertically oriented with respect to each other with the heat removal zone below the combustion zone; (d) removing heat in the heat removal zone by providing heat removal means at least partially immersed in the dense phase fluid catalyst bed of the heat removal zone; (e) passing relatively cool catalyst from the heat removal zone to the combustion zone, through a substantially vertical transfer line having an inlet in a lower locus of the dense phase fluid bed in the heat removal zone and an outlet in a lower locus of the combustion zone, the passing of relatively cool catalyst effected by passing at least a portion of the regeneration gas into the transfer line at a locus below the level of the dense phase fluid bed; and (f) controllably maintaining the extent of immersion of the heat removal means in the dense phase fluid catalyst bed by maintaining the level of the dense phase fluid catalyst bed in the heat removal zone by controlling the quantity of the regeneration gas passed into the transfer line in response to the level.

Other embodiments of the present invention encompass further details such as process streams and the function and arrangement of various components of the apparatus, all of which are hereinafter disclosed in the following discussion of each of the facets of the invention.

BRIEF DESCRIPTION OF THE DRAWING

The FIGURE is a sectional, elevation view of a regeneration apparatus according to the present invention, showing combustion zone 1, heat removal zone 2, and disengagement zone 3.

DETAILED DESCRIPTION OF THE INVENTION

The present invention, in its process aspects, consists of steps for the regenerative combustion within a combustion zone of the coke-contaminated catalyst from a reaction zone to form hot flue gas and hot regenerated catalyst, cooling of a portion of hot regenerated catalyst as a relatively dense phase fluid catalyst bed within a heat removal zone, and the use of portions of regeneration gas to fluidize and control the level of the dense phase catalyst bed in the heat removal zone. A relatively dense phase is understood to be one in which the density of the catalyst/gas mixture is not less than about 30 lbs. per cubic foot.

Reference will now be made to the attached drawings for a discussion of the regeneration process and apparatus of my invention. In the FIGURE, regeneration gas, which may be air or another oxygen-containing gas, enters via several different sources as will be hereinafter discussed and mixes with coke-contaminated catalyst entering in conduit 4 and cooled regenerated catalyst entering via transfer line 5. The resulant mixture of coke-contaminated catalyst, regenerated catalyst and regeneration gas are distributed into the interior of combustion zone 1, at a lower locus thereof, primarily by distributor 6. Coke-contaminated catalyst commonly contains 0.1 to 5 wt. % carbon, as coke. Coke is predominantly comprised of carbon, however, it can contain from 5 to 15 wt. % hydrogen, as well as sulfur and other materials. The regeneration gas and entrained catalyst flows upward from the lower part of combustion zone 1 to the upper part thereof. While it is not critical to the practice of this invention, it is believed that dilute phase conditions, that is a catalyst/gas mixture of less than 30 lbs. per cubic foot, and typically 2–10 lbs. per cubic foot, are the most efficient for coke oxidation. As the catalyst/gas mixture ascends within combustion zone 1 the heat of combustion of coke is liberated and absorbed by the now relatively carbon-free catalyst, in other words by the regenerated catalyst.

The rising catalyst/gas stream enters into inlet 7 of disengagement zone 3 and impinges upon surface 8, which impingement changes the direction of flow of the stream. It is well known in the art that impingement of a fluidized particulate stream upon a surface, causing the stream to turn through some angle, can result in the separation from the stream of a portion of the solid material therein. The impingement of the catalyst-gas stream upon surface 8 causes almost all of the hot regenerated catalyst flowing out of the combustion zone to become disengaged from the gas and collect at the bottom of disengagement zone 3. The bottom of disengagement zone 3 may be an annular cone-shaped receptacle, as shown, or any other shape appropriate for collecting catalyst particles. The gaseous products of coke oxidation and excess regeneration gas, or flue gas, and small amounts of uncollected hot regenerated catalyst exits the disengagement zone and enters separation means 9 through inlet 10. These separation means may be cyclone separators, as schematically shown in the FIGURE, or any other effective means for the separation of particulated catalyst from a gas stream. Catalyst separated from the flue gas falls to the bottom of disengagement zone 3 through conduits 11 and 12. The flue gas exits disengagement zone 3 via conduit 13, through which it may safely proceed to associated energy recovery systems. Having the disengagement zone in upward communication with the combustion zone is advantageous in comparison to schemes in which the gas/catalyst mixture flows upward into a relatively dense phase heat removal zone, in that with the former, there is a substantial reduction in the loading of the regenerator cyclones which virtually eliminates large losses of catalyst from FCC units during operational upsets.

Recycle conduit 14 is attached at one end to a lower part of the disengagement zone and at the other end to a lower part of heat removal zone 2. Hot regenerated catalyst proceeds through this conduit from disengagement zone 3 to heat removal zone 2, the flow rate being controlled by control valve 15.

Temperature recorder control device 16 connects to temperature sensing device 17 by way of line 18, and connects to control valve 15 by way of line 19. The flow rate of the hot regenerated catalyst stream in conduit 14 will be controlled in order to maintain a constant temperature of the catalyst at an upper portion of combustion zone 1. These temperatures will commonly be in the range of 1300°–1400° F. Most of the hot regenerated catalyst will be removed from disengagement zone 3 and passed to the reactor (not shown) via conduit 20.

Relatively dense-phase fluid bed 21 having surface level 22 is maintained within the heat removal zone, rather than a dilute-phase fluid bed, because dense phase conditions afford greatly increased heat transfer rates from the bed to heat removal means 23. Heat removal means 23 are provided to withdraw heat from the dense-phase bed. In a preferred embodiment of the invention the heat removal means comprise conduits of substantially vertical orientation, the interiors of which conduits are sealed from the interior of the heat removal zone, and which conduits have flowing therein a heat absorbing material, such as water which would at least partially be converted to steam as heat is absorbed. The objective is to absorb heat into the heat absorbing material through its indirect contact with dense-phase fluid bed 21. As the heat transfer coefficient is much higher for the section of the tubes immersed in the fluidized bed, than for the section of tubes above the bed, changing the extent of immersion will change the amount of heat removed. The immersion of heat removal means 23 is, in accordance with this invention, varied by the variation in surface level 22 of regenerated catalyst inventory within the heat removal zone. Level 22 of fluid bed 21, and therefore the extent of immersion of heat removal means 23, is controlled through the action of control valve 24 which controls the quantity of regeneration gas passed, via conduit 25, into substantially vertical transfer line 5 having inlet 26 which extends down into dense-phase bed 21. Transfer line 5 exits upward into combustion zone 1 via distributor 6. Fluidized catalyst from bed 21 will enter transfer line 5 via inlet 26 and will tend to establish a level in transfer line 5 about the same as level 22. The regeneration gas which is introduced below the surface of the dense-phase catalyst bed in transfer line 5 carries the catalyst up transfer line 5, through distributor 6 and into combustion zone 1. Level sensing, recording and control device 27 determines level 22 of dense-phase catalyst bed 21 based on the differentials in pressures measured by pressure sensitive devices 28' and 29'. Variations in bed density and/or depth of bed within the dense-phase region will be reflected in a varying pressure differential. Device 27 will then maintain a predetermined level in dense-phase bed 21 by controlling control valve 24 as aforesaid. Device 27 will most efficiently control valve 24 through an additional control device comprising flow controller 40. Device 27 "cascades" to or controls the setting on controller 40, which in turn senses the air flow rate in conduit 25 via flow senser 41 and which then adjusts control valve 24 to obtain a flow rate consistent with the setting. Raising or lowering the level of fluid bed 21 increases or decreases, respectively, the extent of immersion of heat removal means 23 in bed 21 and, thus, the extent of heat removal therefrom. The level of fluid bed 21 will be adjusted from time to time to maintain a bed temperature of from about 1100° F. to about 1300° F.

In order to maintain fluidization of fluid bed 21, a portion of the regeneration gas is introduced into a lower portion of heat removal zone 2 through an appropriate means such as conduit 28 and distributor 29. This gas will flow upward through bed 21 to pass into a lower portion of combustion zone 1. Vents 30 will be of small size so as to enable a high gas velocity through them, thus preventing back flow of catalyst from the combustion zone into the heat removal zone.

The balance of regeneration gas needed for combustion, in addition to the gas provided via transfer line 5 and vents 30, may be passed into combustion zone 1 by an appropriate means such as conduit 31 and distributor 32.

ILLUSTRATIVE EMBODIMENT

The following example represents a particularly preferred mode contemplated for the practice of the invention, expressed in terms of the mass flow rates and temperatures of streams flowing in the regenerator depicted in the attached FIGURE. The regenerator processes spent catalyst from a reaction zone which is cracking a reduced crude oil feedstock. In the tabulation below the streams flowing within conduits are tabulated in registry with the item numbers of the conduits shown in the FIGURE.

| Stream | | lbs./hr. | °F. |
|---|---|---|---|
| 4 | Coke-Contaminated Catalyst (from reactor) | 2,724,552 | 1050 |
| | Catalyst | 2,691,362 | 1050 |
| | Coke | 30,902 | 1050 |
| 25, 28 and 31 | Regeneration Gas | 463,530 | 307 |
| 20 | Hot Regenerated Catalyst from Disengagement Zone | 2,691,362 | 1380 |
| 14 | Hot Regenerated Catalyst Recycled To Heat Removal Zone | 3,621,428 | 1380 |
| 5 | Cooled Regenerated Catalyst (to combustion zone) | 3,621,428 | 1230 |
| 13 | Flue Gas | 493,302 | 1400 |
| 23 | Heat Removed by Heat Removal Means - 149.83 × $10^6$BTU/hr. Heat Losses from Regenerator Vessel - 3.41 × $10^6$BTU/hr. | | |

It should be noted that in this particular operation the feedstock to the reaction zone is a reduced crude oil, a material which yields a relatively high coke production. Such a high coke production, and the consequent, extraordinarily high evolution of heat in the combustion zone made necessary the recycle of 3,621,428 lbs./hr. of cooled regenerated catalyst from the heat removal zone to the combustion zone in order to limit the maximum combustion zone temperature to about 1400° F.

What is claimed is:

1. An apparatus for regenerating a coke-contaminated, fluid catalyst, which apparatus comprises in combination:

(a) a vertically-oriented combustion chamber having means by which said coke-contaminated fluid catalyst may be introduced therein and contacted with regeneration gas;

(b) a disengagement chamber located superadjacent to and above said combustion chamber and in communication therewith;

(c) a heat removal chamber located superadjacent to and below said combustion chamber in which may be maintained a dense-phase fluid catalyst bed;

(d) heat removal means comprising substantially vertically orientated conduits containing heat absorbing material positioned within said heat removal chamber so as to enable immersion of said heat removal means in said dense-phase fluid catalyst bed, said conduits being sealed with respect to the interior of said heat removal chamber such that said heat-absorbing material is in indirect heat exchanging contact with the interior of said heat removal chamber;

(e) a catalyst recycle conduit connecting said disengagement chamber with said heat removal chamber, such that hot regenerated fluid catalyst can pass from said disengagement chamber to said heat removal chamber;

(f) a cooled catalyst transfer conduit of vertical orientation connecting the lower portion of said heat removal chamber with the lower portion of said combination chamber, such that fluid catalyst can pass from said dense-phase fluid catalyst bed in said heat removal chamber to said combustion chamber;

(g) a regeneration gas inlet line connecting with a lower portion of said cooled catalyst transfer conduit for introducing at least a portion of said regeneration gas into said lower portion of said cooled catalyst inlet conduit below the level of said dense-phase fluid catalyst bed, thereby effecting the flow of cooled fluid catalyst from said dense-phase fluid catalyst bed in said heat removal chamber to said combustion chamber; and (h) a control system for maintaining the extent of immersion of said heat removal means in said dense-phase fluid catalyst bed by selectively adjustably maintaining the level of said dense-phase fluid catalyst bed in said heat removal zone comprising means to sense said level of said dense-phase fluid catalyst bed in said heat removal chamber, level control means having an adjustable set point and developing a level output signal, flow control means regulating the rate of flow of said regeneration gas into said cooled catalyst transfer conduit, and means for transmitting said level output signal to said flow control means, wherein said regeneration gas passed through said cooled catalyst transfer conduit is adjusted responsive to said desired level, to maintain said desired level of said dense-phase fluidizing bed and thereby said extent of immersion of said substantially vertically oriented conduits containing said heat absorbing material in said heat removal chamber in accordance with said desired set point.

2. Apparatus of claim 1 further characterized in the inclusion of means for controlling the temperature of regenerated catalyst in the upper region of said combustion chamber, said means for said temperature control comprising means for sensing said temperature, temperature control means having an adjustable set point connecting with said temperature sensing means and developing an output signal, flow control means regulating the rate of flow of hot regenerated catalyst through said catalyst recycle conduit, and means for transmitting said output signal to said flow control means whereby the latter is adjusted responsive to said catalyst temperature.

3. Apparatus of claim 1 wherein means for the introduction of at least a portion of regenerating gas into said heat removal chamber is positioned in a lower portion of said heat removal chamber thereby enabling the fluidization of said dense fluid catalyst bed, and venting means is positioned at an upper portion of said heat removal chamber above the level of said dense fluid catalyst bed to enable the flow of said fluidization gas from said heat removal chamber to a lower portion of said combustion chamber.

* * * * *